US010988700B2

(12) United States Patent
Lee

(10) Patent No.: US 10,988,700 B2
(45) Date of Patent: Apr. 27, 2021

(54) DESULFURIZATION SYSTEM USING CATALYST FOR DESULFURIZATION

(71) Applicant: Cheol Lee, Cheongju-si (KR)

(72) Inventor: Cheol Lee, Cheongju-si (KR)

(73) Assignee: LOWCARBON CO., LTD, Jeollanam-Do (KR)

( * ) Notice: Subject to any disclaimer, the term of this patent is extended or adjusted under 35 U.S.C. 154(b) by 159 days.

(21) Appl. No.: 16/117,569

(22) Filed: Aug. 30, 2018

(65) Prior Publication Data

US 2019/0085255 A1 Mar. 21, 2019

(30) Foreign Application Priority Data

Sep. 18, 2017 (KR) ..... 10-2017-0119814

(51) Int. Cl.
*C10L 10/02* (2006.01)
*C10L 5/04* (2006.01)
(Continued)

(52) U.S. Cl.
CPC ..... *C10L 10/02* (2013.01); *C10L 5/04* (2013.01); *C10L 9/10* (2013.01); *F23J 7/00* (2013.01); *C10L 2200/024* (2013.01); *C10L 2200/029* (2013.01); *C10L 2200/0209* (2013.01); *C10L 2200/0213* (2013.01);
(Continued)

(58) Field of Classification Search
CPC ..... C10L 10/02; C10L 2200/0209; C10L 2200/0213; C10L 2200/0218; C10L 2200/0227; C10L 2200/0231; C10L 2200/0236; C10L 2200/024; C10L 2200/029; C10L 2250/06; C10L 2290/141; C10L 2290/18; C10L 2290/28;
(Continued)

(56) References Cited

U.S. PATENT DOCUMENTS 4,519,807 A * 5/1985 Nishino ..... C10L 9/10 201/17
5,458,689 A * 10/1995 Saito ..... C23C 16/4401 118/715

FOREIGN PATENT DOCUMENTS

CN 105381695 A * 3/2016
KR 10-1990-0017647 A 12/1990
(Continued)

*Primary Examiner* — Latosha Hines
(74) *Attorney, Agent, or Firm* — Lucas & Mercanti, LLP

(57) ABSTRACT

Disclosed is a desulfurization system using a catalyst for desulfurization, including a coal feed unit for conveying a combustible substance, a spray unit for spraying a catalyst for desulfurization, a coal pulverization unit for pulverizing the combustible substance conveyed from the coal feed unit, and a combustion unit for combusting the pulverized combustible substance, wherein during transfer of the combustible substance from the coal feed unit to the coal pulverization unit, the catalyst for desulfurization is sprayed using the spray unit and is mixed with the combustible substance. The desulfurization system of the invention can be simply and easily applied to various combustion facilities because, during the transfer of the combustible substance from the coal feed unit to the coal pulverization unit, the catalyst for desulfurization is sprayed and is mixed with the combustible substance, thereby efficiently reducing sulfur oxide ($SO_x$) emission due to combustion of fossil fuel.

18 Claims, 4 Drawing Sheets

(51) Int. Cl.
*C10L 9/10* (2006.01)
*F23J 7/00* (2006.01)

(52) U.S. Cl.
CPC ..... *C10L 2200/0218* (2013.01); *C10L 2200/0227* (2013.01); *C10L 2200/0231* (2013.01); *C10L 2200/0236* (2013.01); *C10L 2250/06* (2013.01); *C10L 2290/141* (2013.01); *C10L 2290/18* (2013.01); *C10L 2290/28* (2013.01); *C10L 2290/542* (2013.01); *F23K 2200/00* (2013.01)

(58) Field of Classification Search
CPC ..... C10L 2290/542; C10L 5/04; C10L 9/10; F23J 7/00; F23K 2200/00
See application file for complete search history.

(56) References Cited

FOREIGN PATENT DOCUMENTS

| | | | | |
|---|---|---|---|---|
| KR | 10-2004-0100184 | A | 12/2004 | |
| KR | 10-2006-0081654 | A | 7/2006 | |
| KR | 10-0833345 | B1 | 5/2008 | |
| KR | 10-2009-0013116 | A | 2/2009 | |
| KR | 10-0903778 | B1 | 6/2009 | |
| KR | 10-2012-0049000 | A | 5/2012 | |
| KR | 10-1447334 | B1 | 10/2014 | |
| KR | 10-1733447 | B1 | 5/2017 | |
| WO | WO-2012064084 | A2 * | 5/2012 | ..... B01J 35/12 |

* cited by examiner

DESULFURIZATION SYSTEM USING CATALYST FOR DESULFURIZATION

CROSS-REFERENCE TO RELATED APPLICATION

This application claims the benefit of Korean Patent Application No. 10-2017-0119814, filed Sep. 18, 2017, the contents of which are incorporated herein by reference.

FIELD OF THE INVENTION

The present invention relates to a desulfurization system using a catalyst for desulfurization, and more particularly to a desulfurization system, which is capable of reducing emission of sulfur oxide ($SO_x$) upon combustion of a combustible substance using a catalyst for desulfurization having desulfurization activity.

BACKGROUND OF THE INVENTION

Sulfur oxide ($SO_x$) and nitrogen oxide ($NO_x$) are noted pollutants that cause air pollution. In particular, sulfur oxide is present in industrial exhaust gas emitted upon combustion of fossil fuels containing sulfur, thus causing various forms of environmental pollution, such as acid rain and the like.

Desulfurization methods for removing sulfur oxide from such industrial exhaust gas have been continuously studied, and flue gas desulfurization methods, which are post-combustion desulfurization methods, are typically used in factories and fossil-fuel-based power plants.

Flue gas desulfurization methods, including desulfurization of exhaust gas after combustion of fossil fuel containing sulfur gas, are classified into wet methods and dry methods. Wet methods are performed in a manner in which exhaust gas is washed with ammonia water, sodium hydroxide solution, lime liquor, etc. to remove sulfur oxide, and dry methods are conducted in a manner in which exhaust gas is brought into contact with particles or powder such as activated carbon, carbonate, etc. to adsorb or react with sulfur dioxide, thereby removing sulfur oxide.

However, flue gas desulfurization methods are problematic because a desulfurizer for treating exhaust gas has to be additionally provided, extensive labor is required, and high costs are incurred for operation of the desulfurizer, and moreover the desulfurization process is complicated.

Therefore, with the goal of reducing the emission of sulfur oxide related to the combustion of fossil fuel, there is an urgent need for research into a desulfurization method that exhibits superior desulfurization effects and is capable of being carried out in a simple and easy manner at industrial sites.

CITATION LIST

Patent Literature (Patent Document 1) Korean Patent No. 10-0903778
(Patent Document 2) Korean Patent No. 10-1447334

SUMMARY OF THE INVENTION

Accordingly, the present invention has been made keeping in mind the problems encountered in the related art, and the present invention is intended to provide a desulfurization system using a catalyst for desulfurization in order to remove sulfur oxide ($SO_x$) upon combustion of fossil fuel.

Therefore, the present invention provides a desulfurization system using a catalyst for desulfurization, comprising: a coal feed unit for conveying a combustible substance; a spray unit for spraying a catalyst for desulfurization; a coal pulverization unit for pulverizing the combustible substance conveyed from the coal feed unit; and a combustion unit for combusting the pulverized combustible substance, wherein, during transfer of the combustible substance from the coal feed unit to the coal pulverization unit, the catalyst for desulfurization is sprayed using the spray unit and is mixed with the combustible substance.

Also, the catalyst for desulfurization may include a liquid catalyst for desulfurization or a powder catalyst for desulfurization, and the spray unit sprays at least one selected from among the liquid catalyst for desulfurization and the powder catalyst for desulfurization.

Also, the powder catalyst for desulfurization may be fed to a screw conveyor to quantify the amount thereof before being supplied into the spray unit.

Also, the spray unit may spray the liquid catalyst for desulfurization at a spray pressure of 3 to 10 kg/cm$^2$ and an angle of 45 to 68° toward the combustible substance dropping in a rightward (90°) direction, and the spray unit may spray the powder catalyst for desulfurization at a spray pressure of 3 to 5 kg/cm$^2$ and an angle of 0 to 25° toward the combustible substance dropping in a rightward (90°) direction.

Also, a plurality of spray units may be provided.

Also, the spray unit may include a catalyst storage unit for storing the catalyst for desulfurization and a catalyst transfer unit for transferring the catalyst for desulfurization.

Also, the catalyst transfer unit may be provided with a flow meter for measuring and adjusting a flow rate of the catalyst for desulfurization that is transferred.

Also, the amount of the catalyst for desulfurization that is added may be adjusted depending on the amount of sulfur of the combustible substance that is added, the amount of sulfur oxide ($SO_x$) of exhaust gas generated due to combustion of the combustible substance in the combustion unit, and the operating conditions of the combustion unit.

Also, the catalyst for desulfurization may include (a) at least one oxide selected from the group consisting of $SiO_2$, $Al_2O_3$, $Fe_2O_3$, $TiO_2$, MgO, MnO, CaO, $Na_2O$, $K_2O$ and $P_2O_3$, (b) at least one metal selected from the group consisting of Li, Cr, Co, Ni, Cu, Zn, Ga, Sr, Cd and Pb, and (c) at least one liquid compound selected from the group consisting of sodium tetraborate ($Na_2B_4O_7 \cdot 10H_2O$), sodium hydroxide (NaOH), sodium silicate ($Na_2SiO_3$) and hydrogen peroxide ($H_2O_2$).

Also, the oxide may include 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$ and 5 to 20 parts by weight of $P_2O_3$, and the metal may include 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd and 0.003 to 0.005 parts by weight of Pb.

Also, the oxide and the metal may have a particle size of 1 to 2 μm and a specific gravity of 2.5 to 3.0.

Also, the liquid compound may include 20 to 130 parts by weight of sodium tetraborate ($Na_2B_4O_7.10H_2O$), 15 to 120 parts by weight of sodium hydroxide (NaOH), 50 to 250 parts by weight of sodium silicate ($Na_2SiO_3$) and 10 to 50 parts by weight of hydrogen peroxide ($H_2O_2$).

Also, in the catalyst for desulfurization, the oxide, the metal and the liquid compound may be formed into a metal chelate compound.

Furthermore, the catalyst for desulfurization may activate an adsorption effect of sulfur oxide ($SO_x$) at 600 to 900° C.

The desulfurization system according to the present invention can be simply and easily applied to a variety of combustion facilities because, during the transfer of a combustible substance from a coal feed unit to a coal pulverization unit, a catalyst for desulfurization is sprayed using a spray unit and is mixed with the combustible substance, thereby efficiently reducing the emission of sulfur oxide ($SO_x$) due to the combustion of fossil fuel.

Moreover, the desulfurization system according to the present invention obviates the need for a facility for desulfurization of exhaust gas generated after combustion of the combustible substance, and enables the combustible substance to be combusted after mixing with the catalyst for desulfurization, thereby inexpensively, rapidly and easily reducing the emission of sulfur oxide.

DETAILED DESCRIPTION OF THE INVENTION

Hereinafter, a detailed description will be given of a desulfurization system 10 using a catalyst for desulfurization according to embodiments of the present invention with reference to the accompanying drawings.

Figure 1:
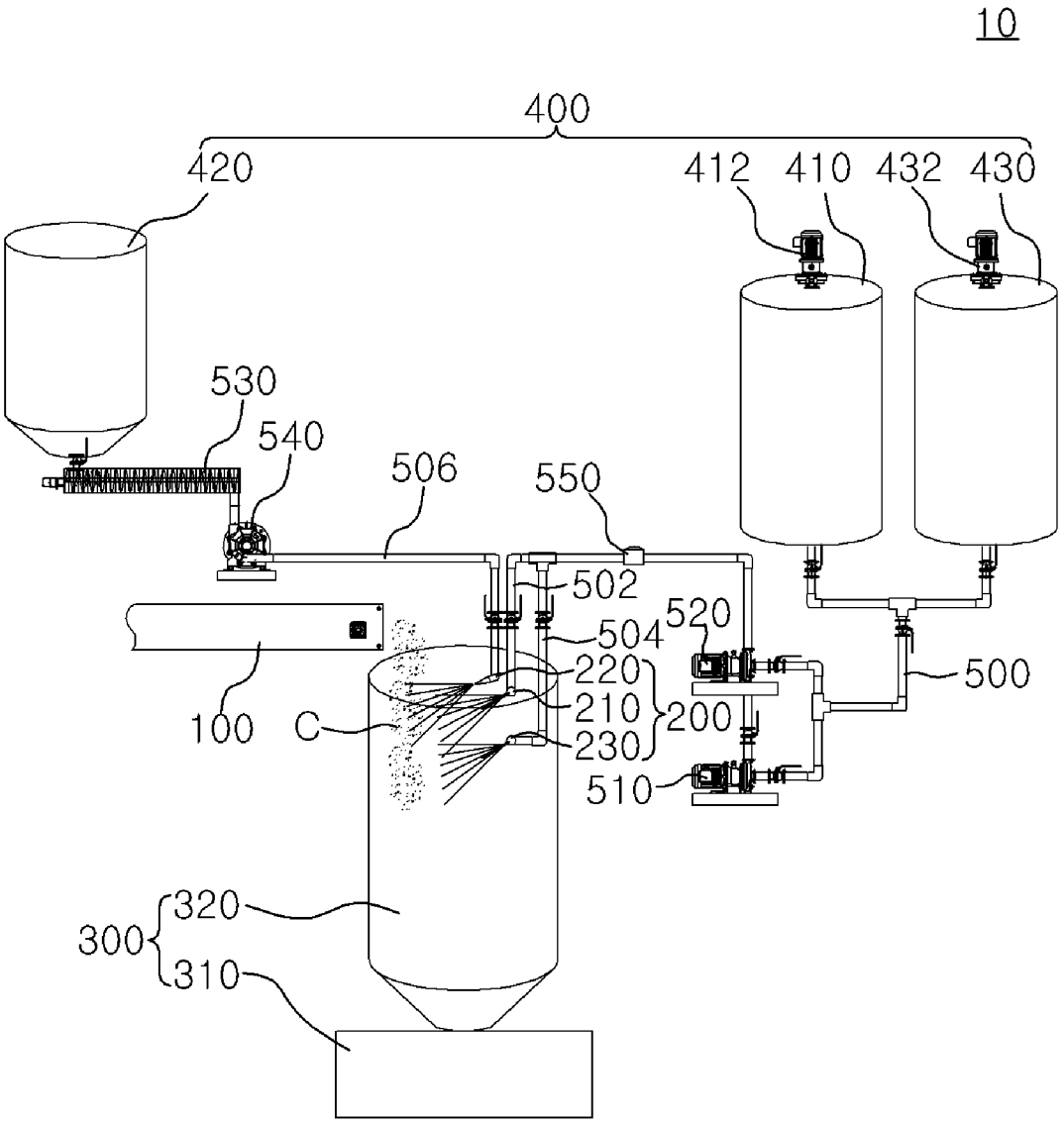
FIG. 1 shows the configuration of a desulfurization system according to an embodiment of the present invention.

FIG. 1 shows the configuration of a desulfurization system 10 using a catalyst for desulfurization according to an embodiment of the present invention.

As shown in FIG. 1, the desulfurization system 10 according to the present invention includes a coal feed unit 100 for conveying a combustible substance C, a spray unit 200 for spraying a catalyst for desulfurization, a coal pulverization unit 300 for pulverizing the combustible substance C conveyed from the coal feed unit 100, and a combustion unit (not shown) for combusting the pulverized combustible substance C, in which, during the transfer of the combustible substance C from the coal feed unit 100 to the coal pulverization unit 300, the catalyst for desulfurization is sprayed via the spray unit 200 and is mixed with the combustible substance C.

The coal feed unit 100 according to the present invention functions to convey the combustible substance C to the coal pulverization unit 300.

The coal feed unit 100 may include a variety of known transfer devices able to convey the combustible substance C, and preferably includes a conveyor belt.

In order to prevent dust scattering or clogging from occurring during the transfer of the combustible substance C from the coal feed unit 100 to the coal pulverization unit 300, the combustible substance C may be transferred using air pressure.

Also, examples of the combustible substance C used in the present invention may include combustibles that generate heat through combustion, such as coal, oil, waste, biogas, and the like, with coal being particularly targeted.

The spray unit 200 of the present invention functions such that the catalyst for desulfurization is sprayed onto and mixed with the combustible substance C that is conveyed from the coal feed unit 100 to the coal pulverization unit 300.

As such, the process of transferring the combustible substance C from the coal feed unit 100 to the coal pulverization unit 300 may include dropping the same from the coal feed unit 100 to the coal pulverization unit 300, or any type of known process for transferring the combustible substance C using a conveyor belt, a screw conveyor, a milling machine, etc., and in the course of transfer of the combustible substance, the catalyst for desulfurization is sprayed using the spray unit 200 and may be mixed with the combustible substance. In an embodiment of the present invention, a process of dropping from the coal feed unit 100 to the coal pulverization unit 300 is adopted. During the dropping of the combustible substance C, the catalyst for desulfurization is mixed through spraying using the spray unit 200.

With reference to the embodiment shown in FIG. 1, the catalyst for desulfurization stored in a catalyst storage unit 400 is transferred using a catalyst transfer unit 500, and the catalyst for desulfurization is sprayed onto and mixed with the combustible substance C that is dropping while being conveyed from the coal feed unit 100 to the coal pulverization unit 300, after which the resulting mixture is supplied into the coal pulverization unit 300.

Useful in the present invention, the catalyst for desulfurization may be used in two types, that is, a liquid catalyst for desulfurization and a powder catalyst for desulfurization, and the spray unit 200 is able to spray at least one selected from among a liquid catalyst for desulfurization and a powder catalyst for desulfurization onto the combustible substance C.

Also, the spray unit 200 may further include the catalyst storage unit 400 for storing the catalyst for desulfurization and the catalyst transfer unit 500 for transferring the stored catalyst for desulfurization.

The catalyst storage unit 400 may be composed of a first catalyst storage unit 410 for storing a liquid catalyst for desulfurization and a second catalyst storage unit 420 for storing a powder catalyst for desulfurization.

Also, the first catalyst storage unit 410 may further include a third catalyst storage unit 430, which is an auxiliary storage unit, in order to be prepared for the case where the liquid catalyst for desulfurization stored in the first catalyst storage unit 410 is completely consumed, and also, the second catalyst storage unit 420 for storing the powder catalyst for desulfurization may further include an auxiliary storage unit.

Also, the catalyst storage units 410, 430 for storing the liquid catalyst for desulfurization may be further provided with stirring motors 412, 432 for preventing the precipitation of materials therein.

Also, provided may be the catalyst transfer unit 500, which is connected to the first catalyst storage unit 410 or the third catalyst storage unit 430 to thus transfer the liquid catalyst for desulfurization into the spray unit 200.

The catalyst transfer unit 500 may be connected to the first catalyst storage unit 410 or the third catalyst storage unit 430 so as to transfer the liquid catalyst for desulfurization into the spray unit 200, and may be provided with a first pressure pump 510 at one side thereof in order to supply transfer pressure. Also, a second pressure pump 520, which is an auxiliary pump, may be further provided in order to be prepared for the failure of the first pressure pump 510.

The catalyst transfer unit 500 may be provided with a flow meter 550 at one side thereof in order to adjust the flow rate of the liquid catalyst for desulfurization. The flow meter 550 functions to measure or adjust the amount of the liquid catalyst for desulfurization to be sprayed, taking into consideration the quality or amount of the combustible substance C that is conveyed from the coal feed unit 100 to the coal pulverization unit 300.

Also, in order to quantify the amount of the catalyst that is fed from the second catalyst storage unit 420 for storing the powder catalyst for desulfurization, the powder catalyst for desulfurization may be fed to the screw conveyor 530 before being supplied into the spray unit 200.

The powder catalyst for desulfurization, quantified by the screw conveyor 530, is subjected to pressure using a third pressure pump 540 and is supplied into the second spray unit 220 by a first catalyst transfer unit 506.

Figure 2:
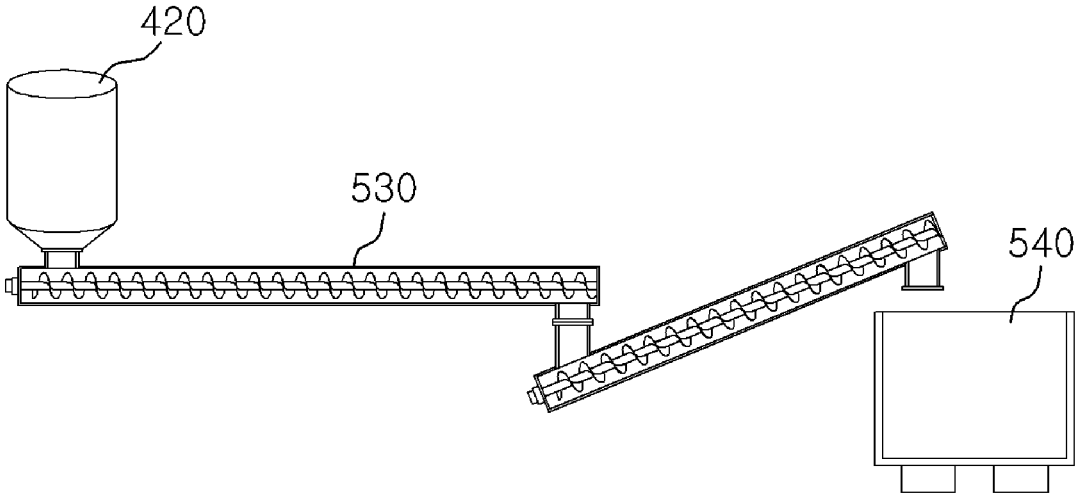
FIG. 2 shows the configuration of a screw conveyor for feeding a powder catalyst for desulfurization in the desulfurization system according to the present invention.

FIG. 2 shows the configuration of the screw conveyor 530 for feeding the powder catalyst for desulfurization. With reference to FIG. 2, while the powder catalyst for desulfurization supplied from the second catalyst storage unit 420 is transferred by the screw conveyor 530, the amount thereof that is fed may be quantified.

Furthermore, the powder agglomerate may be dispersed by the screw conveyor 530, and thus may be uniformly sprayed upon spraying using the spray unit 200.

The powder catalyst for desulfurization transferred via the screw conveyor 530 is conveyed into the third pressure pump 540 and thus subjected to pressure, and is then transferred into the spray unit 200 via the first catalyst transfer unit 506 for transferring the powder catalyst for desulfurization. The first catalyst transfer unit 506 is included in the catalyst transfer unit 500, and the term "first catalyst transfer unit 506" is used in order to distinguish the same from the catalyst transfer unit 500 for transferring the liquid catalyst for desulfurization.

As described above, the liquid catalyst for desulfurization of the first catalyst storage unit 410 and the third catalyst storage unit 430 is supplied into the spray unit 200 by the catalyst transfer unit 500, and the powder catalyst for desulfurization of the second catalyst storage unit 420 is quantified using the screw conveyor 530 and then supplied into the spray unit 200 by the first catalyst transfer unit 506.

The spray unit 200 may include a first spray unit 210 for spraying the liquid catalyst for desulfurization and a second spray unit 220 for spraying the powder catalyst for desulfurization. Also, in order to be prepared for the failure of the first spray unit 210 or the second spray unit 220 or to increase the contact area of the catalyst for desulfurization that is sprayed onto the combustible substance C, a third spray unit 230 may be further provided, thus constituting a plurality of spray units.

Figure 3:
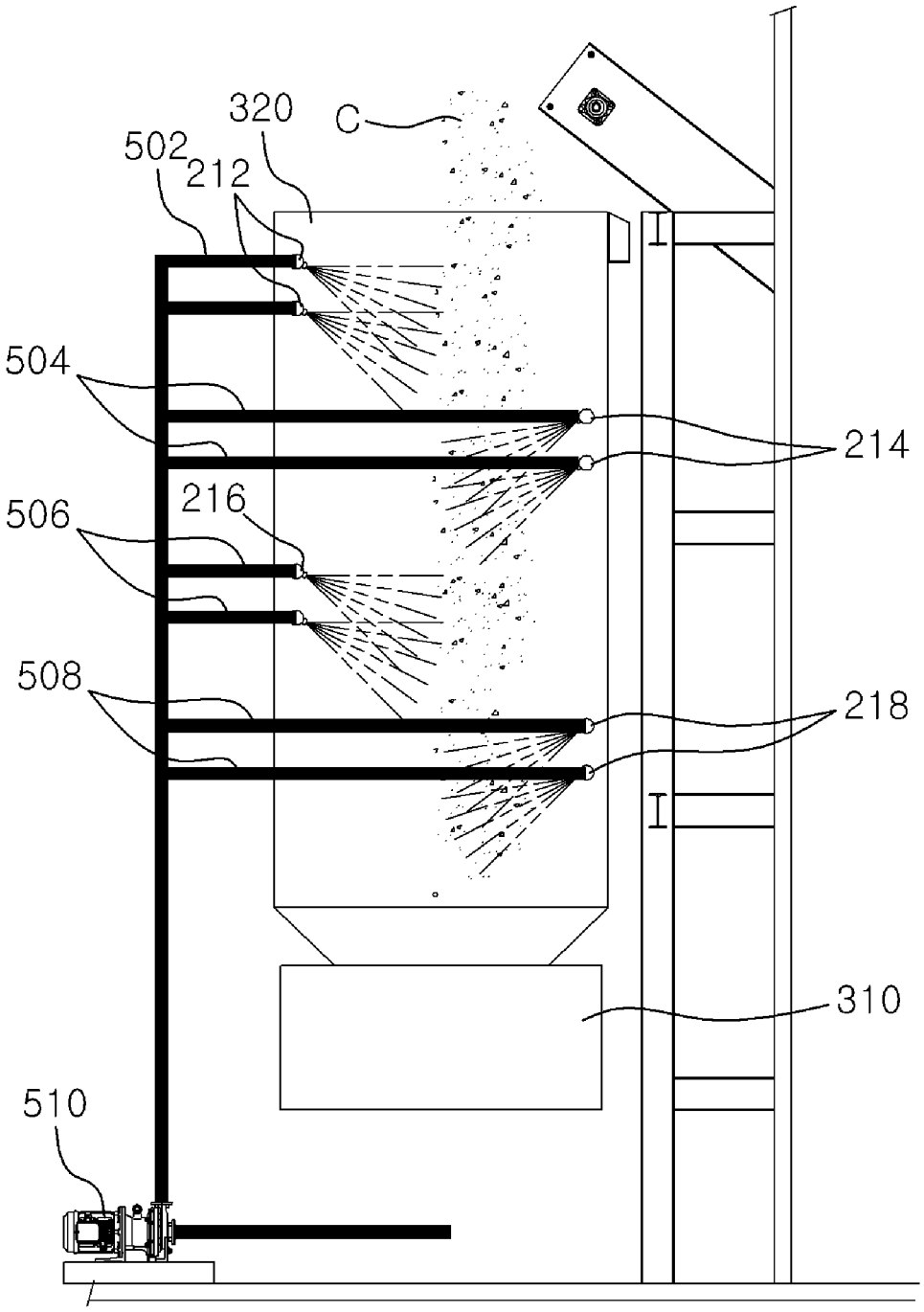
FIG. 3 shows the configuration of a spray unit in the desulfurization system according to the present invention.

FIG. 3 shows the spray unit 200 according to an embodiment of the present invention. With reference to FIG. 3, the liquid catalyst for desulfurization supplied by the first pressure pump 510 is transferred by the catalyst transfer unit 500, and the liquid catalyst for desulfurization is supplied into additional spray units 212, 214, 216, 218 via at least one branched transfer units 502, 504, 506, 508. The liquid catalyst for desulfurization is sprayed onto the combustible substance C that is dropped to be conveyed from the coal feed unit 100 to the coal pulverization unit 300, using the plurality of spray units disposed on both sides of the hopper 320 of the coal pulverization unit 300, thereby increasing the contact area of the combustible substance C and the catalyst for desulfurization. The powder catalyst for desulfurization may also be sprayed using the plurality of spray units as described above.

The plurality of spray units may be located at one side of, both sides of, or positions surrounding the hopper 320, and may be provided at various positions making it possible to increase the contact area of the combustible substance C and the catalyst for desulfurization.

Also, the spray unit 200 may spray the catalyst at a predetermined spray pressure and angle toward the combustible substance C dropping in a rightward (90°) direction from the coal feed unit 100 to the coal pulverization unit 300.

The catalyst for desulfurization may be sprayed at various spray pressures and angles so as to increase the contact area of the combustible substance C and the catalyst for desulfurization, and preferably, the liquid catalyst for desulfurization is sprayed at a spray pressure of 3 to 10 kg/cm$^2$ and an angle of 45 to 68° and the powder catalyst for desulfurization is sprayed at a spray pressure of 3 to 5 kg/cm$^2$ and an angle of 0 to 25°.

Also, the spray unit 200 may be configured such that the amount of the catalyst for desulfurization that is added is adjusted, depending on the amount of sulfur of the combustible substance C that is used, the amount of sulfur oxide ($SO_x$) of exhaust gas that is generated due to combustion of the combustible substance C in the combustion unit, and the operating conditions of the combustion unit.

As for the amount of the catalyst for desulfurization that is added, the amount of the liquid catalyst for desulfurization may be adjusted using a flow meter 550 alone by measuring the flow rate thereof using the flow meter 550, or may be adjusted by wirelessly connecting multiple valves of the catalyst transfer unit 500. Furthermore, the amount of the powder catalyst for desulfurization may be adjusted by controlling the amount of the powder catalyst for desulfurization that is supplied from the second catalyst storage unit 420 to the screw conveyor 530 or by controlling the rate of rotation of the screw conveyor 530.

Figure 4:
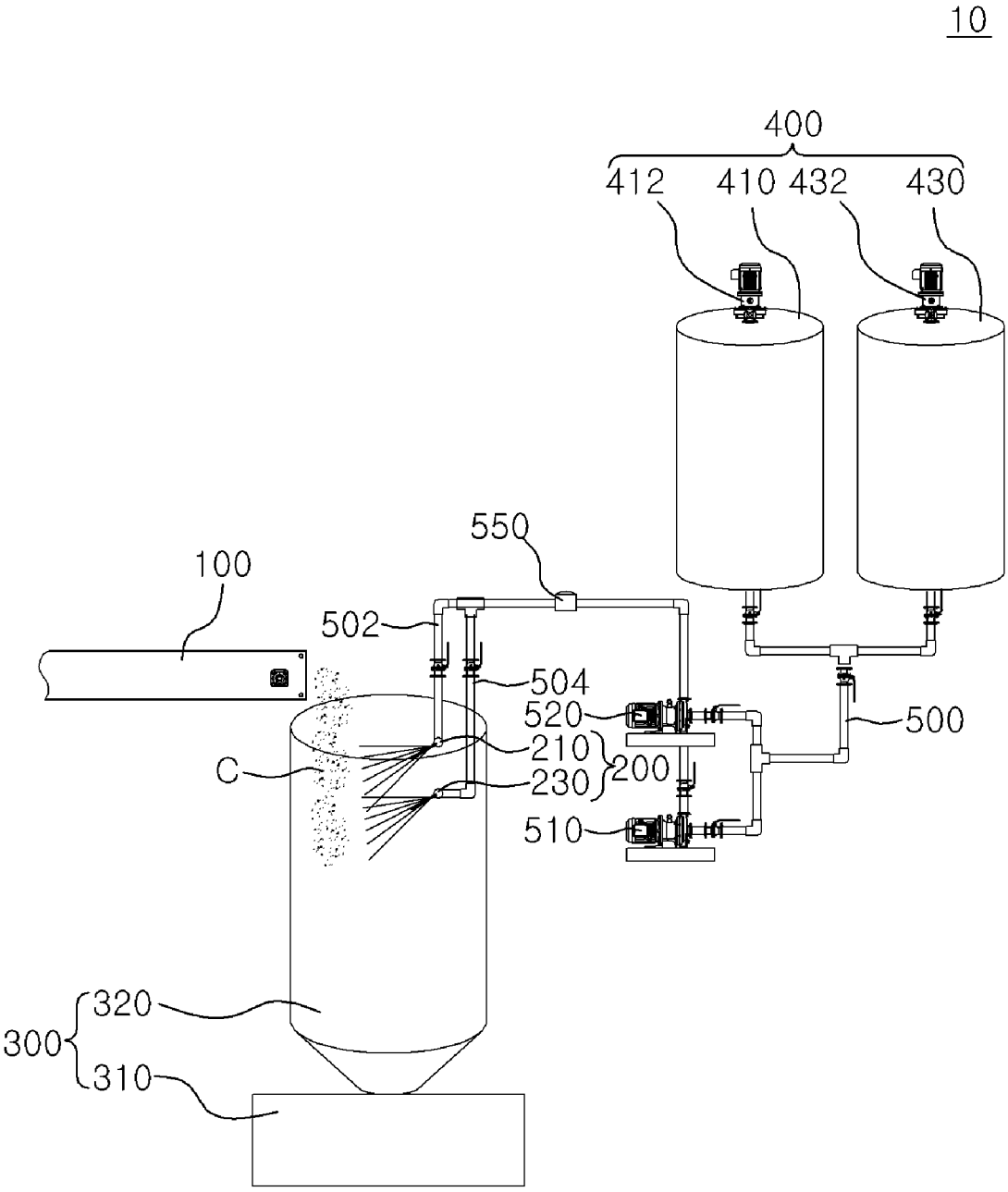
FIG. 4 shows the configuration of a desulfurization system according to another embodiment of the present invention.

FIG. 4 shows a desulfurization system 10 according to another embodiment of the present invention. This desulfurization system 10 may be configured such that a spray unit 200 for spraying only the liquid catalyst for desulfurization is provided, unlike the desulfurization system 10 of FIG. 1 for selectively spraying the liquid catalyst for desulfurization or the powder catalyst for desulfurization.

The desulfurization system shown in FIG. 4 may be applied when using small-scale power plants or a high-quality combustible substance C having low sulfur content.

The catalyst for desulfurization used in the present invention may include at least one oxide selected from the group consisting of $SiO_2$, $Al_2O_3$, $Fe_2O_3$, $TiO_2$, MgO, MnO, CaO, $Na_2O$, $K_2O$ and $P_2O_3$, and preferably includes all oxides of $SiO_2$, $Al_2O_3$, $Fe_2O_3$, $TiO_2$, MgO, MnO, CaO, $Na_2O$, $K_2O$ and $P_2O_3$, as in the following embodiment.

When all of $SiO_2$, $Al_2O_3$, $Fe_2O_3$, $TiO_2$, MgO, MnO, CaO, $Na_2O$, $K_2O$ and $P_2O_3$ are included, the typical chemical formula is represented by $K_{0.8\text{-}0.9}(Al, Fe, Mg)_2(Si, Al)_4O_{10}(OH)_2$, which is a mineral called illite. Here, illite typically has a 2:1 structure, in which one octahedral layer is interposed between two tetrahedral layers and the octahedral layer has a dioctahedral structure due to occupation of only two of three positively charged sites in the binding configuration thereof with cations, thus representing a net negative charge due to the lack of cations. Thereby, when the combustible substance C mixed with the catalyst for desulfurization is combusted, sulfur oxide ($SO_x$) may be adsorbed.

The catalyst for desulfurization may include, as the oxides, 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$ and 5 to 20 parts by weight of $P_2O_3$.

Also, the oxides may be mixed and pulverized to particles having a particle size of 1 to 2 μm using a pulverizer before formation into the catalyst for desulfurization, and may be used in the form of a powder having color streaks and a silvery white color, with a specific gravity of 2.5 to 3.0.

The catalyst for desulfurization according to the present invention may include at least one metal selected from the group consisting of Li, Cr, Co, Ni, Cu, Zn, Ga, Sr, Cd and Pb, and preferably includes all metals of Li, Cr, Co, Ni, Cu, Zn, Ga, Sr, Cd and Pb, as in the following embodiment.

The catalyst for desulfurization may include, as the metals, 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd and 0.003 to 0.005 parts by weight of Pb.

As in the oxides, the metals may be pulverized using a pulverizer and thus have a particle size of 1 to 2 μm, and may be used in the form of a powder having color streaks and a silvery white color, with a specific gravity of 2.5 to 3.0.

The catalyst for desulfurization according to the present invention may include at least one liquid compound selected from the group consisting of sodium tetraborate ($Na_2B_4O_7.10H_2O$), sodium hydroxide (NaOH), sodium silicate ($Na_2SiO_3$) and hydrogen peroxide ($H_2O_2$), and preferably includes all liquid compounds of sodium tetraborate, sodium hydroxide, sodium silicate and hydrogen peroxide, as in the following embodiment.

In the catalyst for desulfurization according to the present invention, the oxide and the liquid compound are mixed and react to thus function as a chelating agent, followed by chelation through coordinate bonding with the metal, thereby forming a metal chelate compound.

Also, the liquid compound may be adsorbed to ashes formed upon combustion of the combustible substance C to thus react with sulfur oxide present in the ashes to remove sulfur oxide. $NaBO_2$ is derived from sodium tetraborate $Na_2B_4O_7$, and is then hydrogenated to produce $NaBH_4$, after which the produced $NaBH_4$ reacts with oxygen and sulfur oxide to give sodium sulfate ($Na_2SO_4$), thereby removing sulfur oxide. These reactions are represented in Schemes 1 and 2 below.

$$NaBH_4+O_3 \rightarrow Na_2O_2+H_2O+B \quad \text{[Scheme 1]}$$

$$1)\ Na_2O_2+SO_3 \rightarrow Na_2SO_4+O$$

$$2)\ Na_2O_2+SO_2 \rightarrow Na_2SO_4$$

$$3)\ Na_2O_2+SO \rightarrow Na_2SO_3 \quad \text{[Scheme 2]}$$

Also, the catalyst for desulfurization may include, as the liquid compounds, 20 to 130 parts by weight of sodium tetraborate, 15 to 120 parts by weight of sodium hydroxide, 50 to 250 parts by weight of sodium silicate and 10 to 50 parts by weight of hydrogen peroxide.

Also, the catalyst for desulfurization, which is mixed and reacted, may be precipitated for 24 to 72 hr and thus stabilized, and the precipitated catalyst for desulfurization is separated and naturally dried, and may thus be used as a powder catalyst for desulfurization. Further, a liquid composition, which remains after separation of the precipitated catalyst for desulfurization, may be used as a liquid catalyst for desulfurization.

The catalyst for desulfurization according to the present invention is capable of activating the adsorption effect of sulfur oxide when the combustible substance is mixed therewith and combusted in the temperature range of 400 to 1200° C., but combustion in the temperature range of 600 to 900° C. may exhibit high efficiency.

In the present invention, the coal pulverization unit 300 functions to pulverize the combustible substance C and the catalyst for desulfurization sprayed by the spray unit 200.

The coal pulverization unit 300 includes a hopper 320 for collecting the combustible substance C supplied from the coal feed unit 100 and a coal pulverizer 310 for pulverizing the supplied combustible substance C, and the combustible substance C mixed with the catalyst for desulfurization is collected in the hopper 320 and is crushed and pulverized using the coal pulverizer 310, thereby exhibiting the effect of mixing the combustible substance C and the catalyst for desulfurization one more time.

In the present invention, the combustion unit (not shown) functions to combust the pulverized combustible substance C supplied from the coal pulverization unit 300 to obtain heat.

For example, the turbine of a power plant may operate using the heat generated from the combustion unit, thereby producing electric power, and the standards and sizes of the catalyst storage unit 400, the catalyst transfer unit 500, the pressure pumps 510, 520, 540 and the spray unit 200 may be adjusted depending on the size of the combustion unit or the amount of power generated from the power plant.

The amount of power generated from the power plant ranges from 1 MW/h to 1000 MW/h, and the amount of coal used as the combustible substance C may vary depending on the size of the boiler that serves as the combustion unit for power generation. In order to apply the catalyst for desulfurization according to the present invention, coal, water and the catalyst for desulfurization may be mixed at a ratio of 1000:10-15:1-30 depending on the size of the boiler and the amount of coal used, followed by combustion.

Depending on the operating conditions of the combustion unit, the amount of the catalyst that is added may vary. The operating conditions and the amount of the added catalyst are summarized in Tables 1 and 2 below.

TABLE 1

| | | Current $SO_x$ emission | Sulfur content of fuel coal used (%) | Operating conditions of combustion unit, $O_2$ concentration (%) | Feed rate of coal (ton/hr) |
|---|---|---|---|---|---|
| Operating conditions & Situation | | 500 ppm | 0.5% | 3.5 | 200 |
| Amount of added liquid catalyst for desulfurization | Coal:Water:Catalyst (1000:10:1)/ton | | | 2 ton | |
| Amount of added powder catalyst for desulfurization | ton | | | 0.2 ton | |
| $SO_x$ emission reduction effect after addition of catalyst | | | | 200 m | |

TABLE 2

| Conditions | | Current $SO_x$ emission | Sulfur content of fuel coal used (%) | Operating conditions of combustion unit, $O_2$ concentration (%) | Feed rate of coal (ton/hr) |
|---|---|---|---|---|---|
| Operating conditions & Situation | | 500 ppm | 0.5% | 4 | 200 |
| Amount of added liquid catalyst for desulfurization | Coal:Water:Catalyst (1000:15:3)/ton | | | 9 ton | |
| Amount of added powder catalyst for desulfurization | ton | | | 0.4 ton | |
| $SO_x$ emission reduction effect after addition of catalyst | | | | 50 pm | |

As is apparent from Tables 1 and 2, the amount of the catalyst for desulfurization that is added varies depending on the current emission of $SO_2$, the sulfur content (%) of the combustible substance C, for example, fuel coal, the $O_2$ concentration (%) supplied into the combustion unit and the amount of coal that is added, or the amount of the liquid catalyst for desulfurization may be set depending on the mixing ratio thereof with the solvent.

The mixture of coal, water and catalyst at a ratio of 1000:10:1 as set forth in Table 1 is sprayed and the mixture of coal, water and catalyst at a ratio of 1000:15:3 as set forth in Table 2 is sprayed. Based on the $SO_x$ emission reduction effects after addition of the catalyst, the current $SO_x$ emission was 500 ppm in the absence of the catalyst, and when the catalyst was mixed and sprayed under the conditions set forth in Table 1, $SO_x$ was emitted at 200 ppm, and when the catalyst was mixed and sprayed under the conditions set forth in Table 2, $SO_x$ emission was reduced to 50 ppm.

In the desulfurization system 10 according to the present invention, the catalyst for desulfurization is added in different amounts in consideration of the sulfur content (%) of coal because there is a significant difference in the purchase price between coal containing 1% sulfur and coal containing 0.5% sulfur. Hence, even when inexpensive coal containing 1% sulfur is used, effects equivalent to when using coal containing 0.5% sulfur may be exhibited, and thus great economic benefits may be realized.

Also, the desulfurization system 10 according to the present invention may be applied to all cases where heat generated by combusting the combustible substance C is used, but is preferably used for a PC (Pulverized Coal Combustion) boiler of a coal-fired power plant using pulverized coal.

As described above, the desulfurization system 10 according to the present invention is configured such that the catalyst for desulfurization is sprayed using the spray unit 200 and is mixed with the combustible substance C during the transfer of the combustible substance C from the coal feed unit 100 to the coal pulverization unit 300, and may thus be simply and easily applied to various combustion facilities, thereby effectively reducing the emission of sulfur oxide ($SO_x$) due to the combustion of the combustible substance C.

Moreover, the desulfurization system 10 according to the present invention obviates the need for a facility for desulfurization of exhaust gas generated after combustion of the combustible substance C, and enables the combustible substance C to be combusted after mixing with the catalyst for desulfurization, and is thereby effective at inexpensively, rapidly and easily reducing the emission of sulfur oxide.

Although preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A desulfurization system using a catalyst for desulfurization, comprising:

a coal feed unit for conveying a combustible substance;

a spray unit for spraying a catalyst for desulfurization;

a coal pulverization unit for pulverizing the combustible substance conveyed from the coal feed unit; and a combustion unit for combusting the pulverized combustible substance, wherein during transfer of the combustible substance from the coal feed unit to the coal pulverization unit, the catalyst for desulfurization is sprayed using the spray unit and is mixed with the combustible substance, wherein the catalyst for desulfurization includes a liquid catalyst for desulfurization or a powder catalyst for desulfurization, wherein the spray unit sprays the liquid catalyst for desulfurization at a spray pressure of 3 to 10 kg/cm2 and an angle of 45 to 68° toward the combustible substance dropping in a rightward(90°) direction, the spray unit sprays the powder catalyst for desulfurization at a spray pressure of 3 to 5 kg/cm2 and an angle of 0 to 25° toward the combustible substance dropping in a rightward(90°) direction; and wherein the powder catalyst for desulfurization is fed to a screw conveyor to quantify an amount thereof before being supplied into the spray unit.

2. The desulfurization system of claim 1, wherein a plurality of spray units is provided.

3. The desulfurization system of claim 1, wherein the spray unit includes a catalyst storage unit for storing the catalyst for desulfurization and a catalyst transfer unit for transferring the catalyst for desulfurization.

4. The desulfurization system of claim 3, wherein the catalyst transfer unit is provided with a flow meter for measuring and adjusting a flow rate of the catalyst for desulfurization that is transferred.

5. The desulfurization system of claim 1, wherein an amount of the catalyst for desulfurization that is added is adjusted depending on an amount of sulfur of the combustible substance that is added, an amount of sulfur oxide ($SO_x$) of exhaust gas generated due to combustion of the combustible substance in the combustion unit, and operating conditions of the combustion unit.

6. The desulfurization system of claim 1, wherein the catalyst for desulfurization comprises:

(a) an oxide selected from the group consisting of $SiO_2$, $Al_2O_3$, $Fe_2O_3$, $TiO_2$, MgO, MnO, CaO, $Na_2O$, $K_2O$ and $P_2O_3$; or (b) a metal selected from the group consisting of Li, Cr, Co, Ni, Cu, Zn, Ga, Sr, Cd and Pb; or (c) a liquid compound selected from the group consisting of sodium tetraborate ($Na_2B_4O_7 \cdot 10H_2O$), sodium hydroxide (NaOH), sodium silicate ($Na_2SiO_3$) and hydrogen peroxide ($H_2O_2$).

7. The desulfurization system of claim 6, wherein the oxide includes 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$ or 5 to 20 parts by weight of $P_2O_3$, and the metal includes 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd or 0.003 to 0.005 parts by weight of Pb.

8. The desulfurization system of claim 6, wherein the oxide and the metal have a particle size of 1 to 2 μm and a specific gravity of 2.5 to 3.0.

9. The desulfurization system of claim 6, wherein the liquid compound includes 20 to 130 parts by weight of sodium tetraborate ($Na_2B_4O_7 \cdot 10H_2O$), 15 to 120 parts by weight of sodium hydroxide (NaOH), 50 to 250 parts by weight of sodium silicate ($Na_2SiO_3$) or 10 to 50 parts by weight of hydrogen peroxide ($H_2O_2$).

10. The desulfurization system of claim 6, wherein, in the catalyst for desulfurization, the oxide, the metal and the liquid compound are formed into a metal chelate compound.

11. The desulfurization system of claim 6, wherein the catalyst for desulfurization activates an adsorption effect of sulfur oxide ($SO_x$) at 600 to 900° C.

12. A desulfurization system using a catalyst for desulfurization, comprising:

a coal feed unit for conveying a combustible substance;

a spray unit for spraying a catalyst for desulfurization;

a coal pulverization unit for pulverizing the combustible substance conveyed from the coal feed unit; and a combustion unit for combusting the pulverized combustible substance, wherein during transfer of the combustible substance from the coal feed unit to the coal pulverization unit, the catalyst for desulfurization is sprayed using the spray unit and is mixed with the combustible substance, wherein the spray unit includes a catalyst storage unit for storing the catalyst for desulfurization and a catalyst transfer unit for transferring the catalyst for desulfurization, wherein the catalyst for desulfurization includes a liquid catalyst for desulfurization or a powder catalyst for desulfurization, wherein the spray unit sprays the liquid catalyst for desulfurization at a spray pressure of 3 to 10 kg/cm$^2$ and an angle of 45 to 68° toward the combustible substance dropping in a rightward(90°) direction, the spray unit sprays the powder catalyst for desulfurization at a spray pressure of 3 to 5 kg/cm$^2$ and an angle of 0 to 25° toward the combustible substance dropping in a rightward(90°) direction; and wherein the powder catalyst for desulfurization is fed to a screw conveyor to quantify an amount thereof before being supplied into the spray unit.

13. The desulfurization system of claim 12, wherein the catalyst transfer unit is provided with a flow meter for measuring and adjusting a flow rate of the catalyst for desulfurization that is transferred.

14. The desulfurization system of claim 12, wherein a plurality of spray units is provided.

15. The desulfurization system of claim 12, wherein an amount of the catalyst for desulfurization that is added is adjusted depending on an amount of sulfur of the combustible substance that is added, an amount of sulfur oxide ($SO_x$) of exhaust gas generated due to combustion of the combustible substance in the combustion unit, and operating conditions of the combustion unit.

16. The desulfurization system of claim 12, wherein the catalyst for desulfurization comprises:

(a) an oxide selected from the group consisting of $SiO_2$, $Al_2O_3$, $Fe_2O_3$, $TiO_2$, MgO, MnO, CaO, $Na_2O$, $K_2O$ and $P_2O_3$; or (b) a metal selected from the group consisting of Li, Cr, Co, Ni, Cu, Zn, Ga, Sr, Cd and Pb; or (c) a liquid compound selected from the group consisting of sodium tetraborate ($Na_2B_4O_7 \cdot 10\ H_2O$), sodium hydroxide (NaOH), sodium silicate ($Na_2SiO_3$) and hydrogen peroxide ($H_2O_2$).

17. The desulfurization system of claim 16, wherein the oxide includes 15 to 90 parts by weight of $SiO_2$, 15 to 100 parts by weight of $Al_2O_3$, 10 to 50 parts by weight of $Fe_2O_3$, 5 to 15 parts by weight of $TiO_2$, 20 to 150 parts by weight of MgO, 10 to 20 parts by weight of MnO, 20 to 200 parts by weight of CaO, 15 to 45 parts by weight of $Na_2O$, 20 to 50 parts by weight of $K_2O$ or 5 to 20 parts by weight of $P_2O_3$, and the metal includes 0.0035 to 0.009 parts by weight of Li, 0.005 to 0.01 parts by weight of Cr, 0.001 to 0.005 parts by weight of Co, 0.006 to 0.015 parts by weight of Ni, 0.018 to 0.03 parts by weight of Cu, 0.035 to 0.05 parts by weight of Zn, 0.04 to 0.08 parts by weight of Ga, 0.02 to 0.05 parts by weight of Sr, 0.002 to 0.01 parts by weight of Cd or 0.003 to 0.005 parts by weight of Pb.

18. The desulfurization system of claim 16, wherein the liquid compound includes 20 to 130 parts by weight of sodium tetraborate ($Na_2B_4O_7 \cdot 10\ H_2O$), 15 to 120 parts by weight of sodium hydroxide (NaOH), 50 to 250 parts by weight of sodium silicate ($Na_2SiO_3$) or 10 to 50 parts by weight of hydrogen peroxide ($H_2O_2$).

* * * * *